US006641236B2

(12) United States Patent
Grudzien

(10) Patent No.: US 6,641,236 B2
(45) Date of Patent: Nov. 4, 2003

(54) CABINET WITH DRAWER RETAINER/ LOCKING SYSTEM

(76) Inventor: Frank T. Grudzien, 67 Railroad Ave., Norwood, NJ (US) 07648

( * ) Notice: Subject to any disclaimer, the term of this patent is extended or adjusted under 35 U.S.C. 154(b) by 0 days.

(21) Appl. No.: 10/103,041

(22) Filed: Mar. 21, 2002

(65) Prior Publication Data

US 2003/0178919 A1 Sep. 25, 2003

(51) Int. Cl.[7] ..... E05C 9/10
(52) U.S. Cl. ..... 312/216; 296/37.6
(58) Field of Search ..... 312/216, 215, 312/222; 296/37.6; 70/78, 158, 163, 164

(56) References Cited

U.S. PATENT DOCUMENTS

| | | | | | |
|---|---|---|---|---|---|
| 341,746 | A | | 5/1886 | Hall | |
| 732,971 | A | | 7/1903 | Stoeffler | |
| 788,966 | A | | 5/1905 | Upton | |
| 924,225 | A | * | 6/1909 | Feely | 312/216 |
| 1,075,652 | A | * | 10/1913 | Kleber, Jr. | 312/304 |
| 1,225,294 | A | | 5/1917 | Weiss | |
| 1,315,709 | A | | 9/1919 | Coombs | |
| 2,913,296 | A | * | 11/1959 | Martin | 312/216 |
| 3,976,343 | A | | 8/1976 | Breckner et al. | |
| 4,303,288 | A | | 12/1981 | Aschinger | |
| 4,632,446 | A | * | 12/1986 | Douglass | 296/37.6 |
| 4,811,999 | A | * | 3/1989 | Remington et al. | 312/249.8 |
| 4,925,257 | A | | 5/1990 | Frederiksen et al. | |
| 5,103,659 | A | * | 4/1992 | Benefield, Sr. | 70/94 |
| 5,685,622 | A | | 11/1997 | Laakso | |

FOREIGN PATENT DOCUMENTS

| | | | | |
|---|---|---|---|---|
| FR | 1144804 | * | 10/1957 | 312/216 |

OTHER PUBLICATIONS

Popular Mechanics, Jul. 1942, pp. 102, "Several Cabinet Drawers Secured by One Padlock" article.*

* cited by examiner

*Primary Examiner*—Korie Chan
(74) *Attorney, Agent, or Firm*—Otho B. Ross

(57) ABSTRACT

Disclosed is an inexpensive and easy-to-use multi-drawer storage cabinet and cabinet drawer retaining/locking system particularly well adapted for use with a mobile cabinet or a cabinet exposed to a shaking environment. The system has only one moving part, namely a rigid cage or frame positioned in front of the drawers and held in place by tracks mounted on either side of the cabinet. In an engaged position, the cage physically prevents the entire bank of drawers from opening, even if the entire cabinet is shaking or moving. In a disengaged position, the cage may be moved away from the drawers to permit the drawers to be opened through the cage while the cage remains mounted on the front of the cabinet for ease of later re-engagement. The retaining/locking system may be either built into a cabinet at the time of manufacture, or retrofitted to an existing cabinet.

1 Claim, 9 Drawing Sheets

CABINET WITH DRAWER RETAINER/ LOCKING SYSTEM

BACKGROUND OF THE INVENTION

This invention relates to storage cabinets having a plurality of drawers. More particularly, this invention relates to a multi-drawer cabinet with a retaining/locking system for preventing cabinet drawers from opening at inappropriate times, such as when the cabinet may be shaken or moved, as in a moving vehicle.

In today's increasingly mobile society, more and more entrepreneurs and craftsmen have a need to travel to customers and other locations with a full set of tools, parts and other items. For many skilled workers, a large number of items often must be transported, sometimes several times a day, in a truck, van, trailer or other vehicle.

Numerous types of multi-drawer storage cabinets, tool boxes and the like are commercially available today for organizing and storing work items, and some of these cabinets may be mounted or placed in a vehicle, such as in the back of a truck or van. A recurring problem, however, is that as the vehicle is driven over rough roads, or when the vehicle turns a corner or starts or stops suddenly, the cabinet is frequently shaken or jarred, and may even slide around or fall over in the vehicle if the cabinet is not fixed to the vehicle. When this happens, the cabinet drawers tend to come open unexpectedly and spill their contents at inappropriate times. Similar undesirable shaking and movable environments are also found on boats and aircraft.

A similar problem also exists in some factories, repair shops or other work environments. For example, if the storage cabinet is located in a busy work area, workers sometimes inadvertently bump into the cabinet, causing some of the drawers to open at inconvenient times. Likewise, if the cabinet is located in an area prone to vibration or exposed to vehicles or heavy equipment, the cabinet may be shaken or jolted unexpectedly, thus causing the drawers to open.

In the past, it has not been feasible to lock and unlock an entire bank of several rows of drawers with one easy movement. One makeshift solution has been for the user to tie rope, cord or flexible straps around the cabinet. But this method has many drawbacks. For example, for cabinets with multiple rows of drawers, each row of drawers must be individually wrapped with a separate piece of rope going around the entire cabinet, which is a time-consuming chore, especially if the cabinet drawers need to be opened and closed frequently. In addition, it is often difficult to wrap rope around a cabinet that is placed flush against a wall or side of a vehicle, or adjacent to other heavy objects. Also, rope has a tendency to slip, become untied or break.

There is also a need for a retaining or locking system that can be both quickly engaged and disengaged by a user needing quick access to the contents of the drawers, especially when a separate lock for the cabinet may not be needed. For example, the cabinet may be located in the back of a van that already has lockable doors, so that a lock on the cabinet may not be needed for security. In this case, a primary function of a cabinet drawer retaining device would be mainly to prevent the drawers from coming out and spilling their contents when the vehicle carrying the cabinet turns a corner or runs over a pothole or other rough road surface. A separate lock on the cabinet could be provided, but may not be necessary.

Thus, a need exists for a simple, inexpensive and easy-to-use device for retaining or locking the drawers of a multi-drawer cabinet with one easy movement, in an environment where the cabinet is frequently shaken or otherwise subject to unpredictable movement, such as in a moving vehicle.

Various types of drawer locking devices for cabinets have been proposed in the prior art. See, for example, the following U.S. Patents: Laakso U.S. Pat. No. 5,685,622; Frederiksen et al. U.S. Pat. No. 4,925,257; Aschinger U.S. Pat. No. 4,303,288; Breckner et al. U.S. Pat. No. 3,976,343; Coombs U.S. Pat. No. 1,315,709; Weiss U.S. Pat. No. 1,225,294; Upton U.S. Pat. No. 788,966; Stoeffler U.S. Pat. No. 732,971; and Hall U.S. Pat. No. 341,746.

For the most part, the devices in the prior art are intended for use with paper file cabinets that are stationary, not tool or parts cabinets, especially those in a mobile or shaking environment such as a vehicle. In addition, prior art cabinet drawer locking devices are generally internal to the cabinet and are designed to be manufactured as an integral part of the cabinet. Cabinets originally made without a lock generally cannot be retrofitted with these prior art locking devices. Also, the cabinets and locking devices of the prior art generally use several moving parts, thus adding complexity and expense to the manufacture of the cabinet.

SUMMARY OF THE INVENTION

To overcome the aforementioned disadvantages of the prior art, disclosed is a simple, inexpensive and easy-to-use cabinet and drawer retaining/locking system particularly well adapted for use with a mobile storage cabinet having a plurality of rows of drawers that can be pulled open horizontally.

The retaining/locking system of the present invention has only one moving part. The moving part is a rigid cage or frame positioned in front of the cabinet drawers and held in place by tracking systems mounted on either side of the cabinet. When engaged in a secured or locked position, the cage physically prevents the entire bank of drawers from opening, even if the cabinet is shaking or moving.

The retaining/locking cage consists of a plurality of approximately parallel bars, held together by a rectangular frame. In an engaged position, the cage presses against the external front surface of each cabinet drawer to prevent all drawers from opening. Guide pins formed on each corner of the cage slidably engage with carefully positioned and shaped slots in tracking systems mounted on either side of the cabinet. The weight of the cage, together with guide pin retainers on the guide pins, hold the cage in place.

In an engaged position, the cage is held against the front of all the drawers of the cabinet. Each bar of the cage is positioned directly in front of each row of drawers. The position of the bars relative to the cabinet drawers is determined by careful vertical positioning of slots in the side-mounted tracks. In this arrangement, in the engaged position, the cage physically prevents all cabinet drawers in all rows (i.e., the entire bank of drawers) from opening, even if the entire cabinet is moving or shaking.

The cage may be moved into a disengaged position by lifting the cage slightly upward; swiveling the bottom of the cage outwardly away from the cabinet to remove the guide pins from the slots; sliding the cage down the tracks; swiveling the bottom of the cage toward the cabinet; and then inserting the guide pins into different, opening slots in the tracks. The opening slots are carefully positioned relative to the rows of drawers so that, in the disengaged position, each bar rests in front of the space between adjacent rows of drawers. In this arrangement, any or all of the drawers may be pulled out through the spaces between the bars, to permit the user to gain access to the items within the drawers. Meanwhile, the entire cage remains mounted on the front of the cabinet (although not directly in front of the drawers) for easy re-engagement if needed. Re-engagement is accomplished by reversing the above-described sequence of movements. The cage may also be entirely removed from the cabinet if desired. The retaining/locking system may be either built into a cabinet at the time of manufacture, or retrofitted to a suitable existing cabinet.

BRIEF DESCRIPTION OF THE DRAWINGS

These and other features and advantages of the invention will now be described with reference to the drawings of certain preferred embodiments, which are intended to illustrate and not to limit the invention, and in which like reference numbers represent corresponding parts throughout, and in which.

DETAILED DESCRIPTION OF THE INVENTION

In what follows, an embodiment of the present invention will be described in detail with reference to the accompanying drawings.

Figure 1:
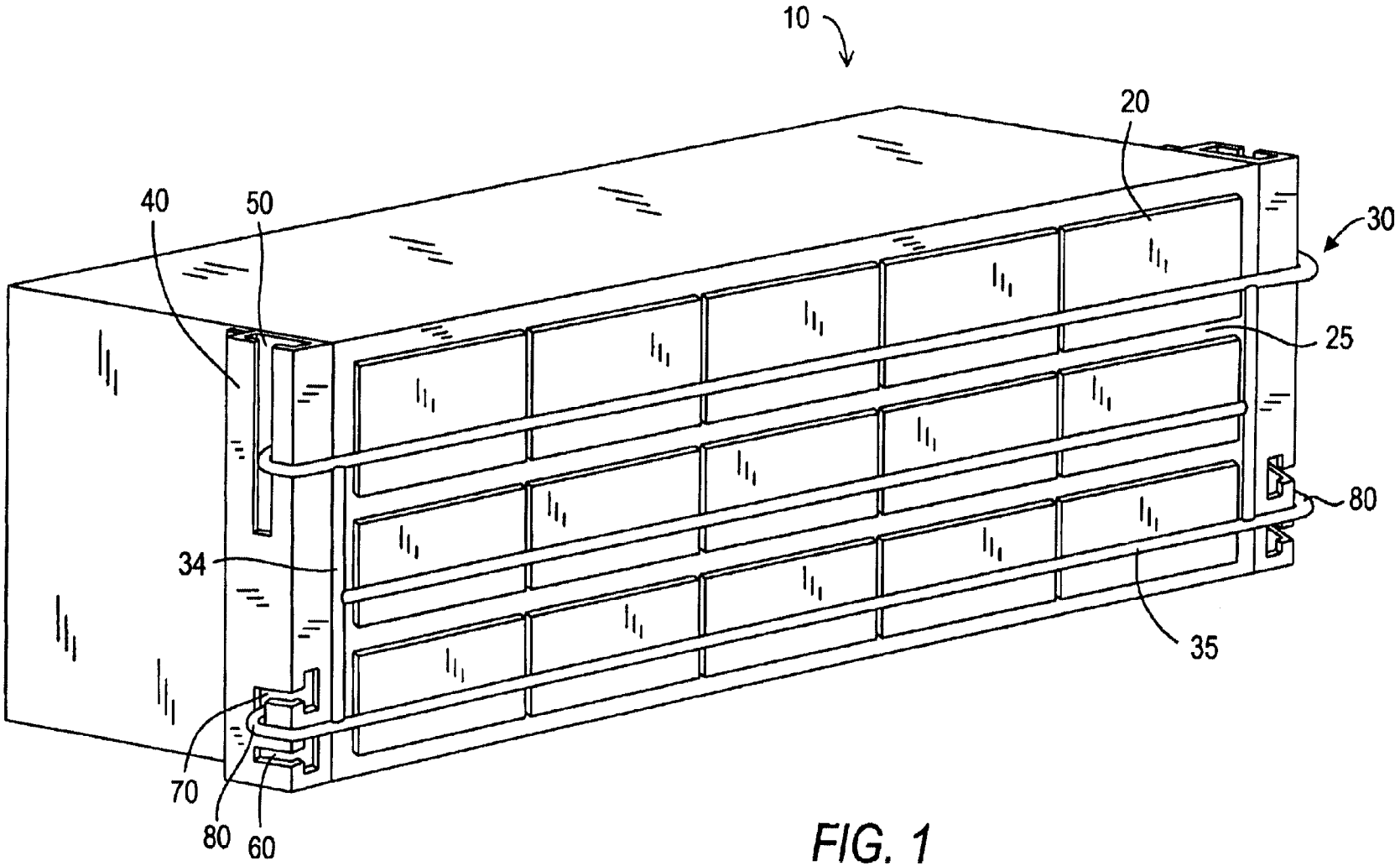
FIG. 1 is a front perspective view of the cabinet of the invention with the retaining/locking cage engaged.

Looking first at FIG. 1, there is shown a front perspective view of a storage cabinet 10. The cabinet is preferably box-like in shape, but this is not required. In one embodiment, the cabinet may be constructed of rigid flat panels of metal, wood, plastic or any other suitable material attached to each other at the edges, and the cabinet is preferably strong enough to support a plurality of internal drawer tracks or support shelves (not shown) holding a plurality of drawers containing items such as hand tools and parts. In a preferred embodiment, the cabinet 10 is also suitable to be carried in a vehicle such as a truck or van, and strong enough to withstand repeated shaking and sliding around as the vehicle is driven over rough roads. In another embodiment, the cabinet is suitable to withstand jolting in a stationary environment.

Within cabinet 10 are, preferably, a plurality of substantially parallel rows of drawers 20, preferably arranged in approximately horizontal fashion. In one embodiment, the drawers may be constructed of rigid flat panels of any material suitable for holding items such as hand tools and parts. The drawers are preferably all the same size and rectangular in cross-section, but this is not required. Preferably, the drawers are accessible from the front of cabinet 10, and the drawers may be opened by pulling them out approximately horizontally. The drawers may be either slidably mounted on internal drawer tracks or shelves (not shown), or mounted on rollers (not shown) that roll along drawer tracks.

The rows of drawers 20 are adjacent to each other, but not touching. Preferably, the rows of drawers are spaced apart (separated) by a small distance, so as to define a narrow drawer spacer strip 25 on the front of the cabinet. In one embodiment, spacer strip 25 is at least ¼ inch wide. In other words, in this embodiment, the front panels of vertically adjacent drawers are at least ¼ inch away from each other, and the front panels of the drawers in the top and bottom rows are at least ¼ inch away from the top and bottom panels, respectively.

Also shown in FIG. 1 is a retaining/locking cage 30, which is a significant feature of the invention. Here, cage 30 is shown slidably mounted on the front of the cabinet 10. The cage is not permanently attached to the cabinet, as is discussed below.

Figure 6:
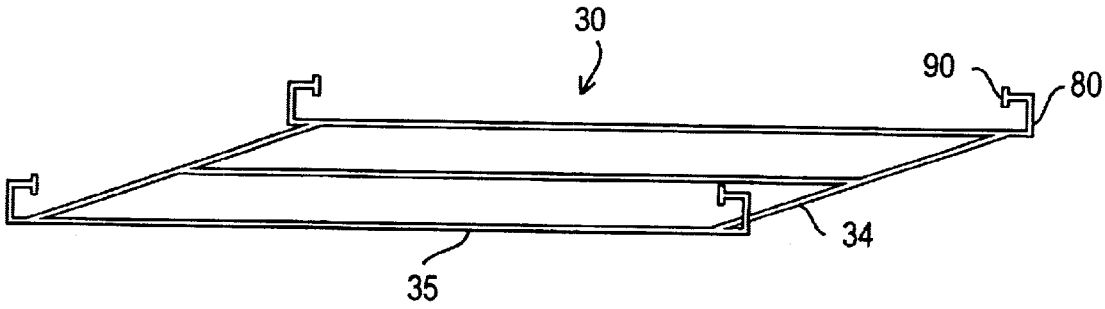
FIG. 6 is a top perspective view of the retaining/locking cage removed from the cabinet.
Figure 7:
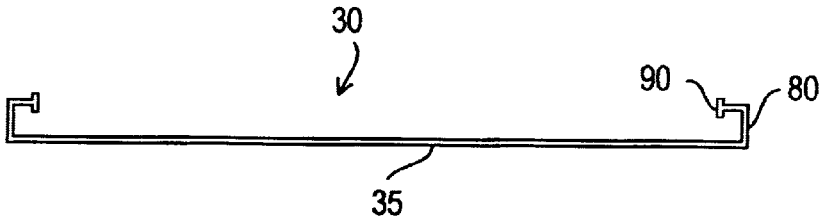
FIG. 7 is a top view of the retaining/locking cage removed from the cabinet.

Cage 30 is shown in more detail in FIGS. 6 and 7. FIG. 6 shows a top perspective view and FIG. 7 shows a top view. In one embodiment, cage 30 comprises a plurality of elongated retaining/locking bars 32, approximately parallel to one another. Each bar is approximately the same length and width, and each end of each bar is attached to a side bar 34, so as to form a rigid structure approximately rectangular in shape. In a preferred embodiment, the bars and side bars comprise rods made of iron, steel or other strong material. They may be attached to each other by welding, bolting or other method of attachment, or the entire structure may be stamped out of sheet metal or the like so as to form a unitary construction.

Figure 2:
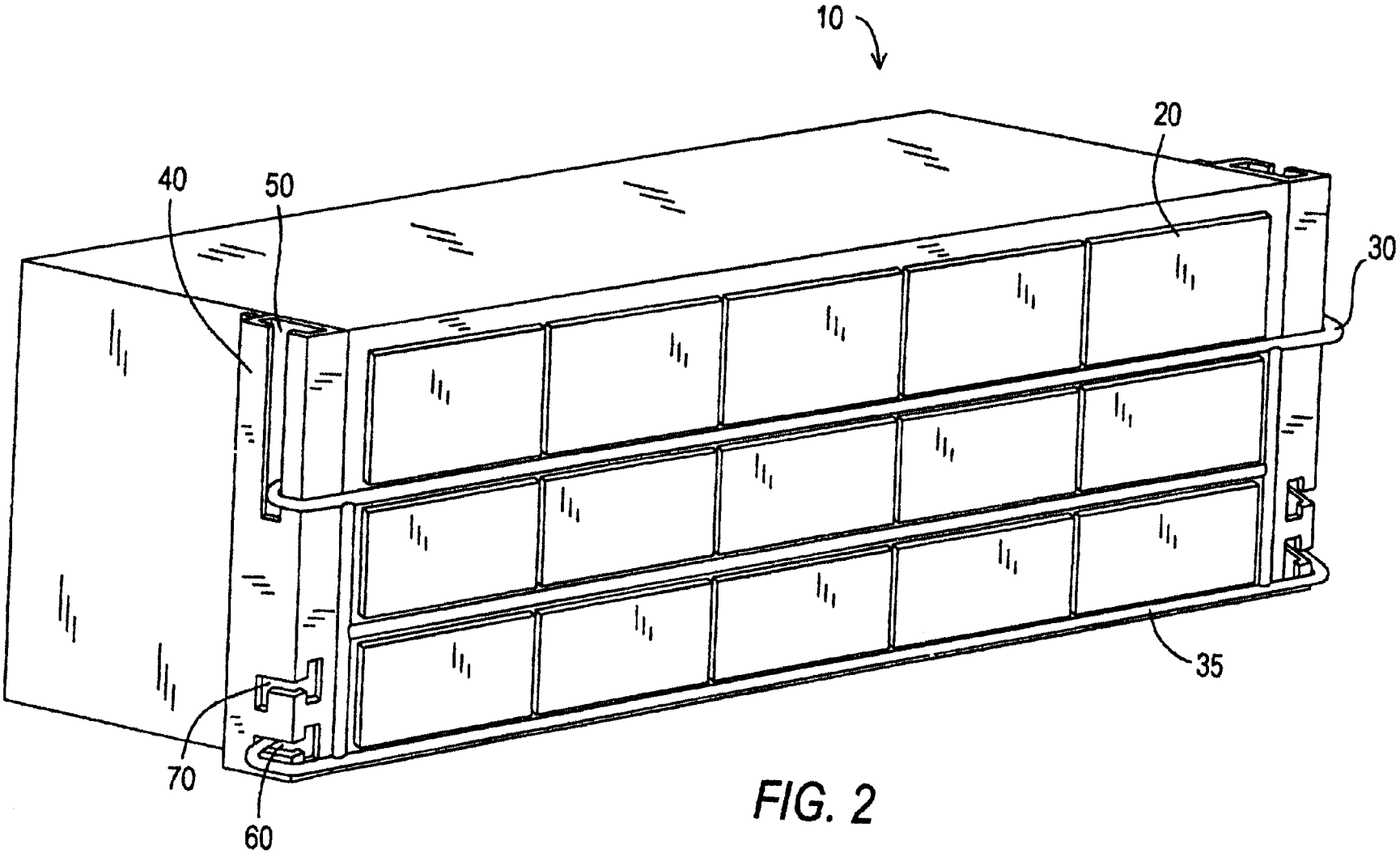
FIG. 2 is a front perspective view of the cabinet of the invention with the retaining/locking cage disengaged.
Figure 3:
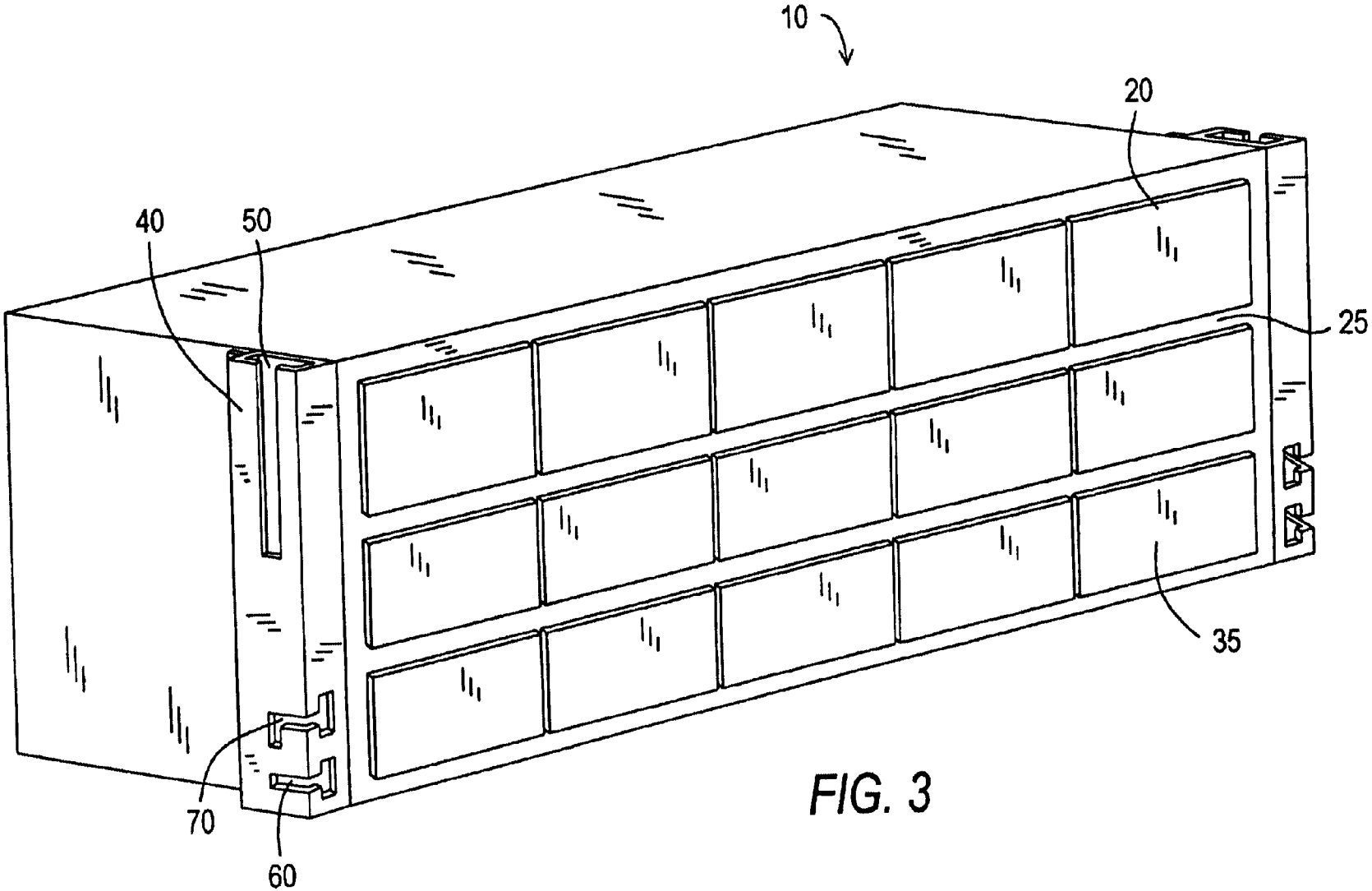
FIG. 3 is a front perspective view of the cabinet of the invention with the retaining/locking cage removed.
Figure 4:
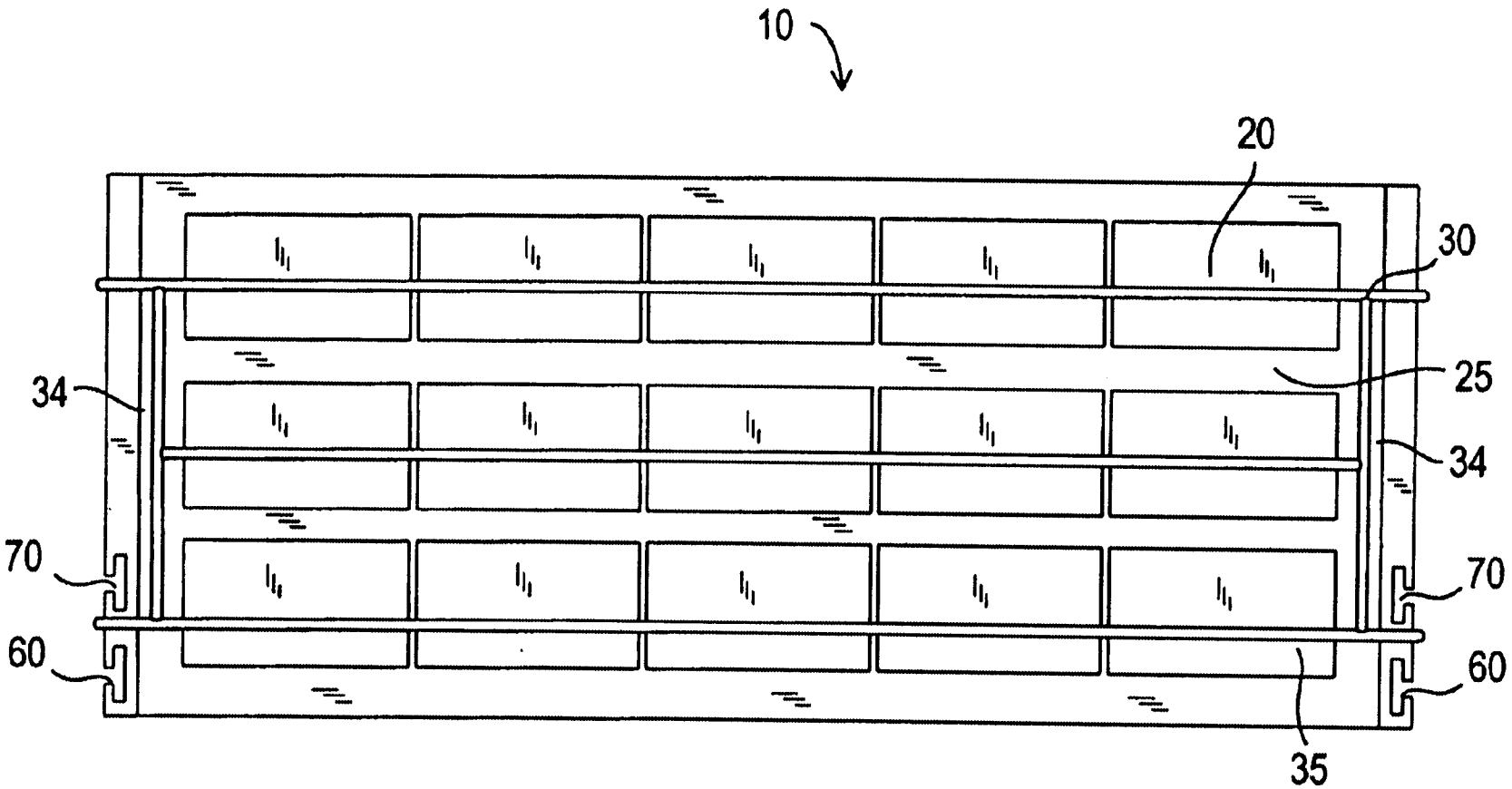
FIG. 4 is a front view of the cabinet of the invention with the retaining/locking cage engaged.
Figure 5:
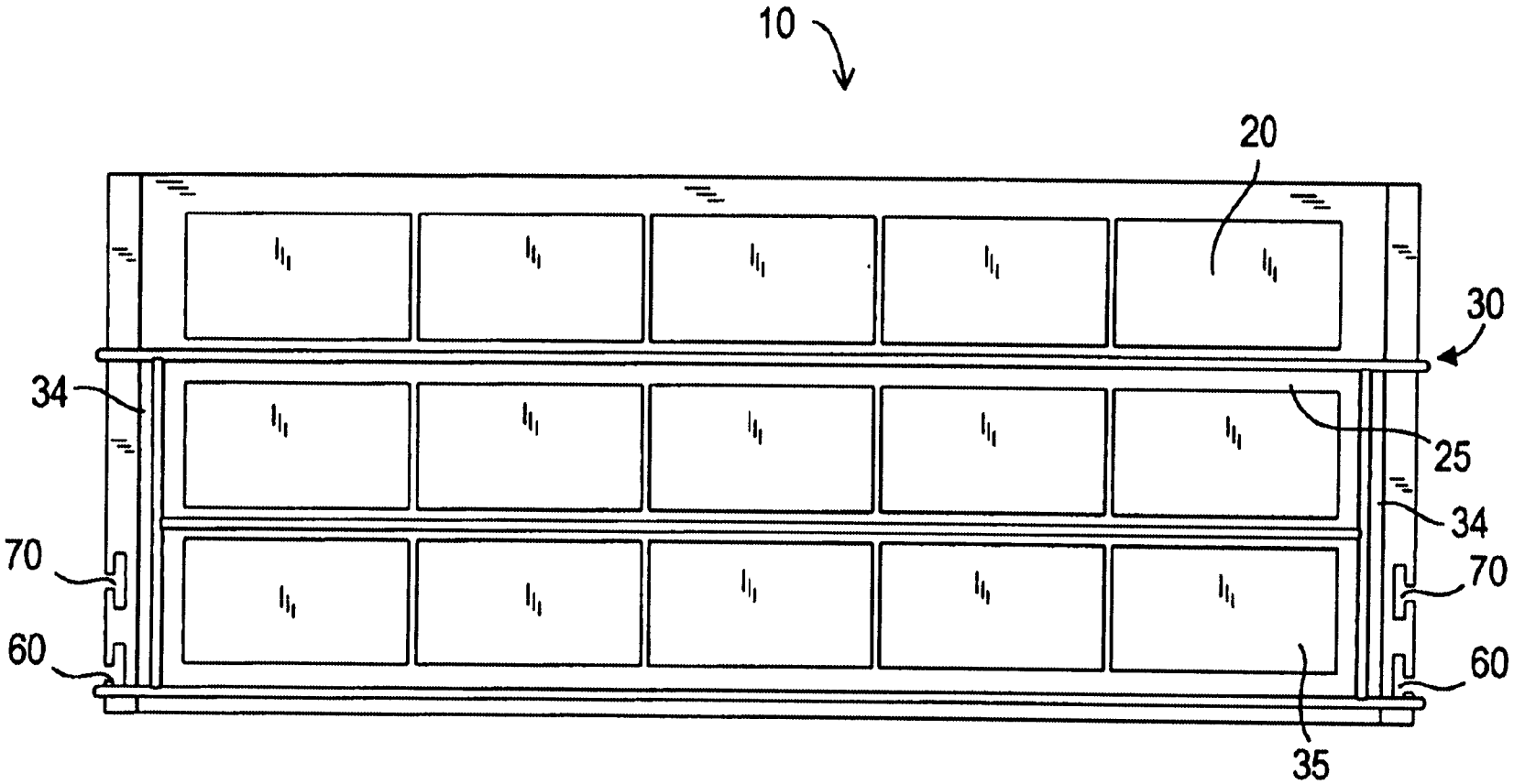
FIG. 5 is a front view of the cabinet of the invention with the locking/locking cage disengaged.

In a feature of the invention, the bars 35 (FIG. 6) are separated from each other by a distance slightly greater than the height of each drawer 20 (see FIG. 1). The purpose for this separation is to permit the drawers to be opened through the cage 30 when the cage is in a disengaged position. See FIG. 2. This is also discussed in more detail below.

In another feature of the invention, the width of each bar 35 is slightly smaller than each drawer spacer strip 25. This is illustrated in FIGS. 1, 2, 4 and 5. The purpose for this feature is to permit the bars to be moved out of the way of the drawers during disengagement of the cage, as is discussed in more detail below.

Referring again to FIG. 6, attached to each corner of the cage 30 is a small guide pin 80. Each pin is preferably C-shaped and is strong enough to support the weight of the entire cage without breaking or significantly bending. Attached to the end of each guide pin is a guide pin retainer 90, which may comprise a small rod, bar or disk. A purpose of the pins 80 and guide pin retainers 90 is to hold the cage 30 in place when the cage is mounted to the front of the cabinet 10. This is illustrated in FIGS. 1, 2, 9 and 10, and is discussed in more detail below.

Referring again to FIG. 1, another significant feature of the invention is the use of two tracking systems or tracks 40 that are preferably mounted externally and on either side of the cabinet 10 near the front. These tracks are illustrated in FIGS. 2, 3, 8, 9 and 10. In a preferred embodiment, each track comprises an elongated, rigid, hollow, box-like structure of sheet metal or other suitable material that is strong enough to support the weight of the cage, and is suitable for being securely attached to the outside of the cabinet. The track has a vertical guide slot 50 cut or formed into its upper portion. The track also has two other slots cut or formed into its lower portion, namely upper slot 70 and lower slot 60. Slots 70 are preferably "T-and-L" shaped, and slots 60 are preferably "T-shaped." Both slots wrap around the front outside corner of the track. The width of the slots is slightly greater than the width of the guide pins 80 on the side of the track and slightly greater than the width of the guide pin retainers 90 on the front of the track, to permit the guide pins 80 to be inserted into the slots from the front.

Figure 8:
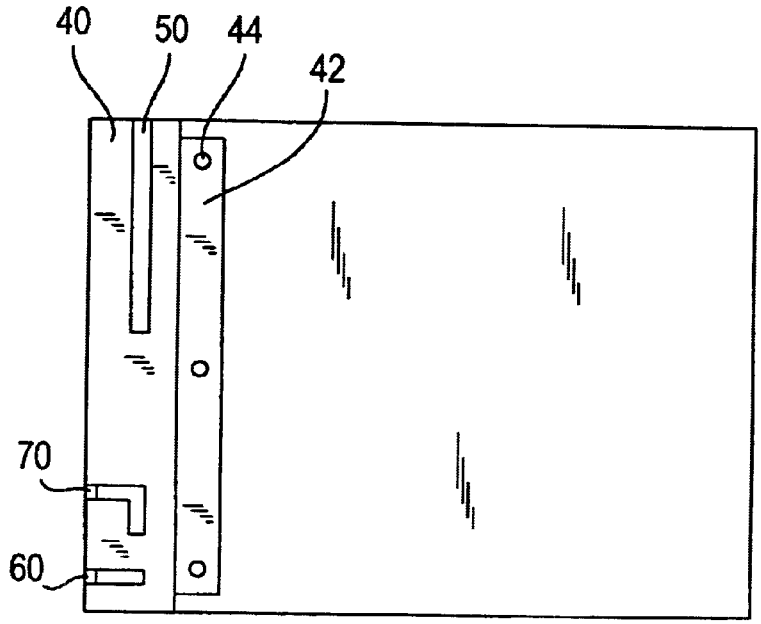
FIG. 8 is a front view of one of two tracking systems, shown installed on the outside of one side of the cabinet, with the retaining/locking cage removed.
Figure 9:
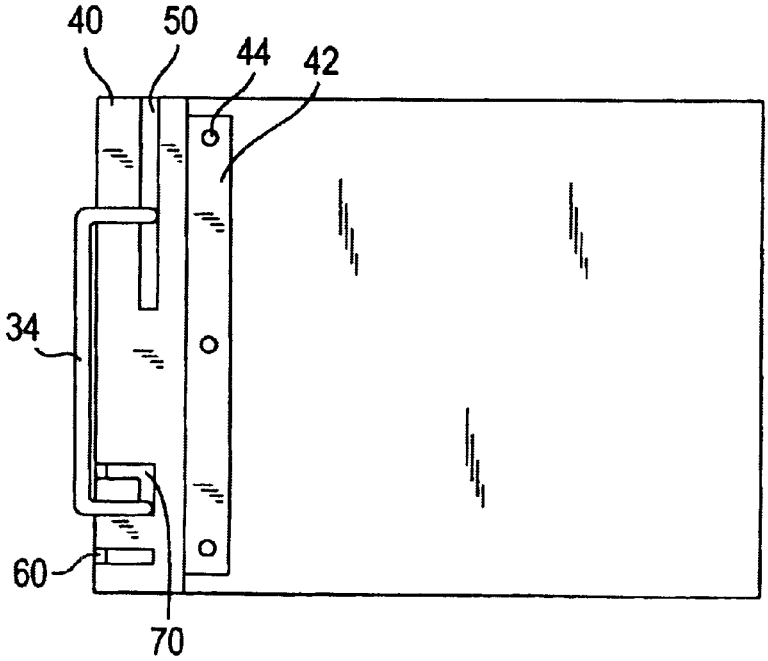
FIG. 9 is a front view of a tracking system, shown installed on the outside of one side of the cabinet, with the retaining/locking cage mounted and engaged.
Figure 10:
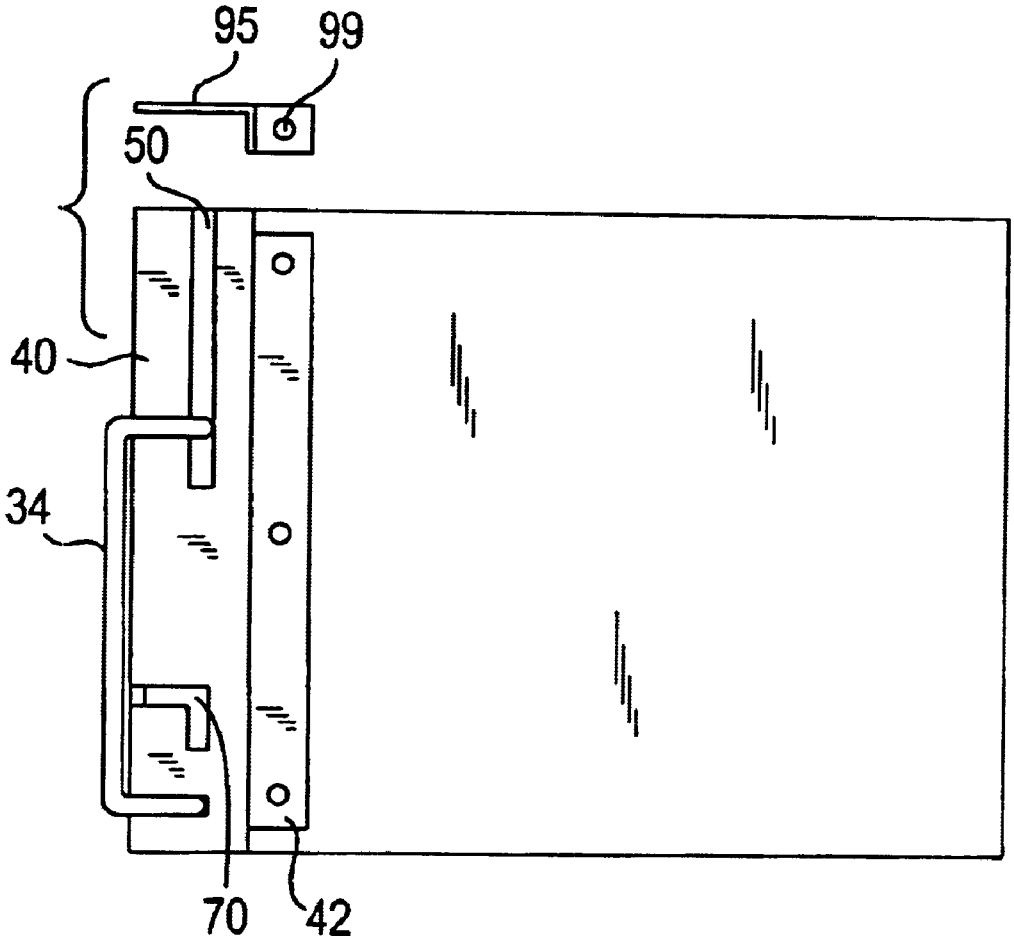
FIG. 10 is a front view of a tracking system, as installed on the outside of one side of the cabinet, with the retaining/locking cage mounted and disengaged, and showing the top track stop.
Figure 11:
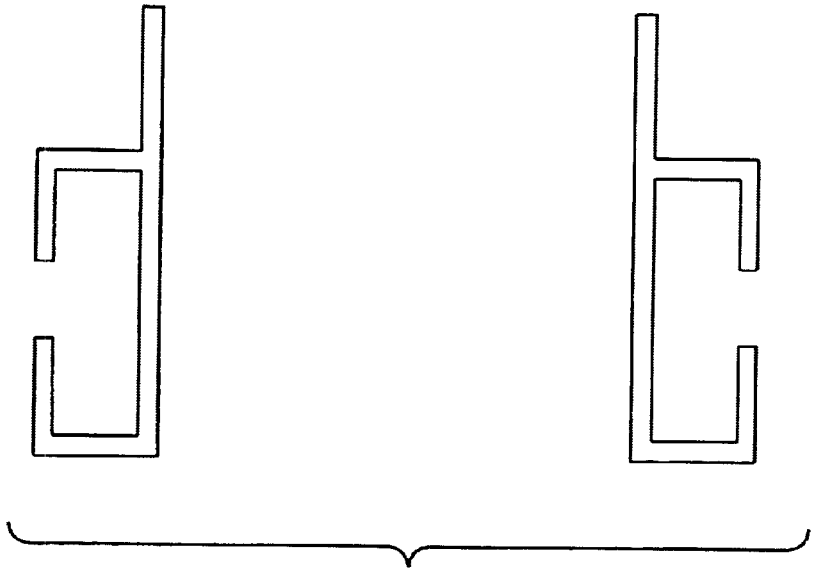
FIG. 11 is a top view of the retaining/tracking systems removed from the cabinet.

Tracks 40 are shown in more detail in the side views of FIGS. 8–10 and top view 11. FIG. 8 shows a track attached to one side of the cabinet, with no cage present. FIG. 9 shows a track system with the cage engaged with the track. FIG. 10 shows a track with the cage disengaged.

In FIG. 8, one track 40 is shown mounted on one side of the cabinet. A mounting flange 42, attached to or integral to both tracks, includes holes 44 to permit mounting of the track to be done with screws or bolts. The tracks could also be welded to the cabinet or manufactured to be integral with the cabinet. Slots 50, 60 and 70 have a width slightly greater than the width of the guide pins 80 of the cage 30, so that the guide pins may be easily inserted into the slots. The front portions of slots 60 and 70 also have a width slightly greater than the width of the guide pin retainers 90, to allow the retainers 90 to be inserted into those portions of those slots. Once the lower guide pins 80 are inserted into the slots 70, they can then be lowered into the downward "L" portion of the slot to hold the cage 30 in place.

Tracks 40 serve several purposes, which are significant features of the invention. First, they provide structures for mounting or holding the cage 30 against the front of the cabinet. They also provide a means for the user to slide the cage into an engaged position to lock or restrain the drawers of the cabinet in place, and to slide the cage into a disengaged position to unlock or disengage the drawers, while the cage remains mounted in front of the cabinet.

Another significant feature of the invention is the particular shape and position of the slots 70 and 60 formed or cut into each of the tracks 40. The vertical distance between the two slots in each track is designed to allow the cage to move up and down in the tracks between an engaged position and a disengaged position in the shortest movement possible, consistent with a need for the cage to keep the drawers closed while the cabinet is being shaken or moved. To meet this need, in a preferred embodiment, the distance between slots 60 and 70 is at least ¼ the height of a front panel of a drawer 20. However, the distance could be less or more. FIGS. 1–4 illustrate one possible positioning of the slots.

A purpose of the slots 60 and 70 is to allow the cage to be engaged and disengaged quickly. Basically, in the engaged position of the cage, as long as the bars 35 are physically positioned somewhere in front of the drawers 20, then the invention will operate to prevent the drawers from opening when not needed. It will be noticed in FIG. 8 that slot 70 has a "T-L" shape. This permits the lower guide pins 80 of the cage to be held securely within the tracks 40 so as to keep the cage from accidentally disengaging from the cabinet when the cabinet is moved or shaken. The weight of the cage keeps the guide pins 80 within the rear vertical L-shaped portions of the slots 70.

Figure 12A:
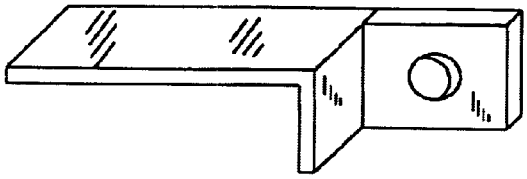
FIG. 12A is a front perspective view of a top track stop.
Figure 12B:
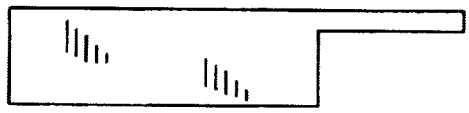
FIG. 12B is a top view of a top track stop.

FIGS. 10, 12A and 12B show another feature of the invention, namely top track stops 95, which may be optionally attached to the top of tracks 40. Stop 95 preferably is an L-shaped member that can be attached to the tops of tracks 40 to prevent the cage 30 from being disengaged from the cabinet when disengagement is not desired, such as when a vehicle carrying the cabinet shakes or moves violently. Track stops 95 may be bolted or screwed to the top of the tracks with mounting flange 97 through a mounting hole 99. Mounting hole 99 lines up with mounting hole 44 on mounting flange 42 of track 40 to eliminate the need for extra mounting screws or drilling.

In operation, a preferred embodiment of the invention may be used as follows. To engage the cage 30 for the first time, the user positions the cage above the cabinet 10, inserts the two upper guide pins 80 into guide slots 50 in the upper portion of each track 40, and then slides the cage down until the lower guide pins are positioned in front of the two slots 70 in the lower portion of each track. The user then pushes the bottom of the cage toward the cabinet so that the bottom guide pins are inserted into the slots 70 fully. The cage is then permitted to drop down slightly by gravity as the lower guide pins slide down the back (L-shaped) portions of slots 70. This brings the cage flush against the front of the cabinet, and firmly held in place. As noted previously, the location of the slots 70 in the tracks 40 is carefully positioned relative to the rows of drawers so that, in the engaged position, the bars 35 press against the fronts of all the drawers. Guide pins 80 with guide pin retainers 90 on the cage slidably engage firmly with the slots 70 in the tracks 40 to hold the cage firmly in place. In this position, the bars of the cage physically block all drawers of the cabinet from opening, even if the entire cabinet is strongly and repeatedly shaken, jarred or moved around, such as in a moving vehicle traveling over a rough road, or if the cabinet is in another environment subject to moving, shaking or jolting.

To disengage the cage 30 to allow the drawers 20 to be opened, in a preferred embodiment of the invention, the user lifts up the cage slightly, then pulls the bottom of the cage outwardly to release the bottom guide pins 80 from the slots 70 of the tracks 40. The cage is then lowered until the bottom guide pins 80 are positioned in front of lower slots 60 in the lower portion of each track 40. The bottom guide pins 80 are then inserted fully into the slots 60, and the guide pin retainers 90 hold the cage 30 in place. In this position, the bars 35 no longer press against the fronts of the drawers 20. Instead, each bar now rests in front of the horizontal spacer strip area 25 on the front of the cabinet that is defined by the spacing between adjacent rows of drawers. Since, in this disengaged position, the bars no longer block the drawers, the drawers may be pulled out through the openings between adjacent bars. In a preferred embodiment, in the disengaged position, the cage 30 remains mounted on the front of the cabinet (although not directly in front of the drawers) for ease of later re-engagement or re-locking. However, if desired, the user may remove the cage entirely by sliding it up the tracks 40 and then lifting it above and away from the cabinet 10.

It may be noted that a feature of the invention is that all parts of the locking system are external to the cabinet, and are externally mountable, so that the locking system may retrofitted to cabinets originally made without a lock. Also, the construction of the system with only one moving part permits it to be easily and inexpensively manufactured and installed on virtually any cabinet, as well as easily operated. The retaining/locking system may also be built into a new cabinet at the time of manufacture, if desired.

While the invention has been described herein with reference to certain preferred embodiments, these embodiments have been presented by way of example only, and not to limit the scope of the invention.

What is claimed is:

1. A cabinet drawer restraining/locking system for a storage cabinet having a plurality of drawers, the cabinet suitable for use in a shaking environment, the system comprising:

a rigid, movable cage slidably mounted external to the cabinet and in front of all the drawers; and tracking systems externally mounted on either side of the cabinet and engaging the cage for holding the cage in place in front of the drawers in either an engaged position or a disengaged position, whereby in the engaged position the cage presses against the drawers and in the disengaged position the cage is slid downwardly away from the drawers while the cage remains mounted on the cabinet, to permit the drawers to be opened through the cage.

* * * * *